United States Patent [19]

Beran et al.

[11] Patent Number: 4,976,065

[45] Date of Patent: Dec. 11, 1990

[54] CONTROL APPARATUS FOR DOORS

[75] Inventors: Mark A. Beran, Niwot; Allan J. Evans, Boulder, both of Colo.

[73] Assignee: BC Research and Development, Inc., Niwot, Colo.

[21] Appl. No.: 438,854

[22] Filed: Nov. 20, 1989

[51] Int. Cl.[5] ..... E05D 15/02

[52] U.S. Cl. ..... 49/43; 192/105 CD

[58] Field of Search ..... 49/42, 43; 192/105 CD

[56] References Cited

U.S. PATENT DOCUMENTS

| | | | |
|---|---|---|---|
| 20,368 | 5/1858 | Pusey | 192/105 CD |
| 482,677 | 9/1892 | Dorton | 192/105 CD |
| 2,051,008 | 8/1936 | Peremi et al. | 49/43 |
| 3,308,912 | 3/1967 | Sheckells | 49/43 X |
| 3,349,876 | 10/1967 | Sheckells | 49/43 X |
| 3,364,620 | 1/1968 | Hess et al. | 49/43 |
| 3,693,771 | 9/1972 | DeLancey | 192/105 CD |
| 3,717,954 | 2/1973 | Sheckells | 49/43 |
| 3,968,595 | 7/1976 | Sheckells | 49/43 |
| 4,119,591 | 10/1978 | Aldreck | 74/109 X |

*Primary Examiner*—Gary L. Smith
*Assistant Examiner*—Jerry Redman
*Attorney, Agent, or Firm*—Harold A. Burdick

[57] ABSTRACT

A speed control apparatus for controlling the rate of motion of a door is disclosed which includes a shaft connected with the door by a gear train for causing rotation of the shaft at a preselected relative rate of rotation related to the rate of motion of the door by a preselected ratio, a braking assembly including a brake drum spaced from the shaft and first and second brake shoes pivotably connected at one end thereof with a carrying member attached to the shaft and having a single biasing spring adjustably connected between the other ends thereof, the brake shoes having a contact surface made of a non-asbestos friction material for contacting the brake drum when a selected rate of rotation of the shaft is exceeded, and an improved housing which is more efficiently sealable against invasion of moisture into the housing and the escape of lubricants from the housing.

20 Claims, 3 Drawing Sheets

CONTROL APPARATUS FOR DOORS

FIELD OF THE INVENTION

This invention relates to control apparatus for doors, and, more particularly, relates to apparatus for controlling the rate of motion of a door by controlling the rate of rotation of a shaft operatively connected therewith.

BACKGROUND OF THE INVENTION

Speed control systems have been heretofore known and utilized, particularly in association with manually actuated revolving doors, with the purpose of such systems being to limit the rate of motion, or rotation, of the door. Such devices as have been heretofore known have typically employed oppositely directed spinning masses mounted on guide pins to a carrying member connected to the shaft so that the masses and the shaft rotate within a brake drum. A standard gear train is connected with the shaft and with the centrally rotating rod of the revolving door in order to develop the mechanical advantage necessary to deliver the proper amount of braking torque to the revolving door (for example the rotation of the door being related to the rotation of the shaft at a ratio of about 1 to 100. The rotating masses have been heretofore biased inwardly by a pair of springs each one of which is connected between the rotating masses at different sides thereof.

While such heretofore known speed control systems have met with some acceptance, such systems have not proven completely successful, and in particular have proven difficult to adjust and/or maintain in proper adjustment to provide desired engagement of the rotating masses with the brake drum. The shaft speed at which the masses engage the drum depends primarily on the total spring preload force (i.e., the sum of the preloads on each of the individual springs between the rotating masses), and in such known two spring systems it has heretofore been necessary that the preload force of the two springs be essentially the same in order to prevent binding of the masses on the guide pins.

Furthermore, such known devices have not always proven effective where, for example, the friction material utilized on the rotating masses becomes lubricated, for example by water seeping through joints in, or lubricants maintained within, the housing. Further improvements in such speed control systems could thus still be utilized.

SUMMARY OF THE INVENTION

This invention provides a control apparatus for controlling the rate of rotation of a shaft connected with a door to thus control the rate of motion of the door, with the apparatus including a restraining member, such as a brake drum, positioned around and spaced from the shaft and rotation limiting structure, preferably first and second brake shoes, pivotably connected with the shaft so that when the shaft rotates the rotation limiting structure revolves around the shaft adjacent to the restraining member. The rotation limiting structure is biased away from the restraining member and has a contact surface for contacting the restraining member when a selected rate of rotation of the shaft is exceeded to thus encumber free rotation of the shaft.

A converting mechanism is provided between the shaft and the door for causing rotation of the shaft at a preselected relative rate of rotation, the relative rate of rotation being related to the rate of motion imparted to the door under the control of a user of the door by a selected ratio, and for responding to encumbrance of the rate of rotation of the shaft caused by contact between the contact surface of the rotation limiting structure and the restraining member to control the rate of motion of the door and thus inhibit motion thereof in excess of a selected desirable rate.

The contact surface of the rotation limiting structure is preferably a non-asbestos friction material exhibiting substantially the same coefficient of friction in contact with the restraining member when wet as when dry. An improved housing is provided which is more easily sealed to prevent leakage of liquids into or from the housing (such as water from the exterior or lubricating oils from the interior of the housing).

The apparatus may be used in association with a variety of doors including revolving doors, swing doors, and/or sliding doors (where conventional means to convert linear into rotary motion is provided). The rotation limiting structure is biased utilizing a single biasing member connected therewith, thus eliminating the need for any additional biasing means and simplifying adjustment and maintenance of the apparatus.

It is therefore an object of this invention to provide an improved control apparatus for controlling the rate of motion of a door.

It is another object of this invention to provide a control apparatus for controlling the rate of rotation of a shaft connected with a door to thus control rate of motion of the door which includes a restraining member positioned around and spaced from the shaft, rotation limiting structure pivotably connected with the shaft and including a contact surface for contacting the restraining member when a selected rate of rotation of the shaft is exceeded, a biasing member connected with the rotation limiting structure for biasing the contact surface away from the restraining member, and converting means connected between the shaft and the door for causing rotation of the shaft at a preselected relative rate of rotation with respect to the rate of motion imparted to the door and for responding to encumbrance of the rate of rotation of the shaft caused by contact between the contact surface of the rotation limiting structure and the restraining member to thus control the rate of motion of the door and inhibit motion thereof in excess of a selected desirable rate.

It is another object of this invention to provide an apparatus for controlling the rate of motion of a door which includes braking surfaces which are substantially equally effective when wet, or lubricated, as when dry.

It is still another object of this invention to provide an apparatus for controlling the rate of rotation of a shaft connected with a door to thus control the rate of motion of the door wherein a rotation limiting member is biased away from a cylindrical wall by a single biasing member and without need for additional biasing means.

It is yet another object of this invention to provide a speed control apparatus for controlling the rate of rotation of a revolving door which includes a braking assembly and converting means housed within a housing which includes a main body and first and second cover sections, a part of the first cover section being sealably positionable against both a horizontal and a vertical surface of the main body, and a part of the second cover section being sealably positionable against a horizontal surface of the first cover section.

It is yet another object of this invention to provide a speed control apparatus for controlling the rate of motion of a door wherein first and second brake shoes each having a first end part pivotably connected with a shaft and each having a second end part having a biasing spring connected therebetween are provided for selective engagement thereof with a brake drum upon rotation of the shaft in excess of a desirable rate of rotation.

With these and other objects in view, which will become apparent to one skilled in the art as the description proceeds, this invention resides in the novel construction, combination and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
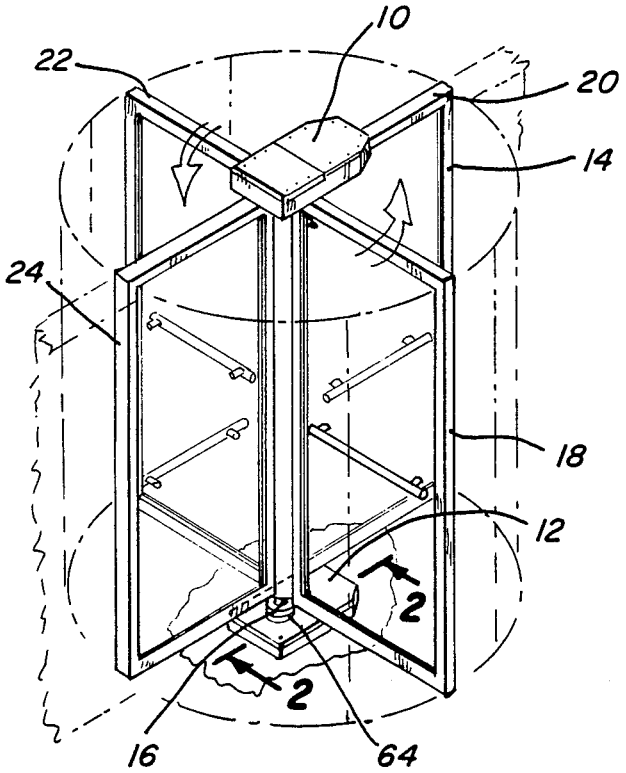
FIG. 1 is a perspective view illustrating use of the apparatus of this invention mounted below and above a revolving door.

Use of the apparatus of this invention in association with a revolving door (it being understood that the apparatus could be utilized in association with swing doors and/or sliding doors where means of converting linear to rotational motion is provided) is illustrated in FIG. 1. The apparatus in this case includes a top mount unit 10 and a bottom mount unit 12 (the utilization of top and bottom mount designs being conventional, such designs being functionally equivalent but with housings specific to the location of the unit either at the top or bottom pivot of the revolving door), with the revolving door 14 connected therebetween at central rotatable rod 16 Such revolving doors are typically provided with a plurality of door panels, for example panels 18, 20, 22 and 24.

Figure 2:
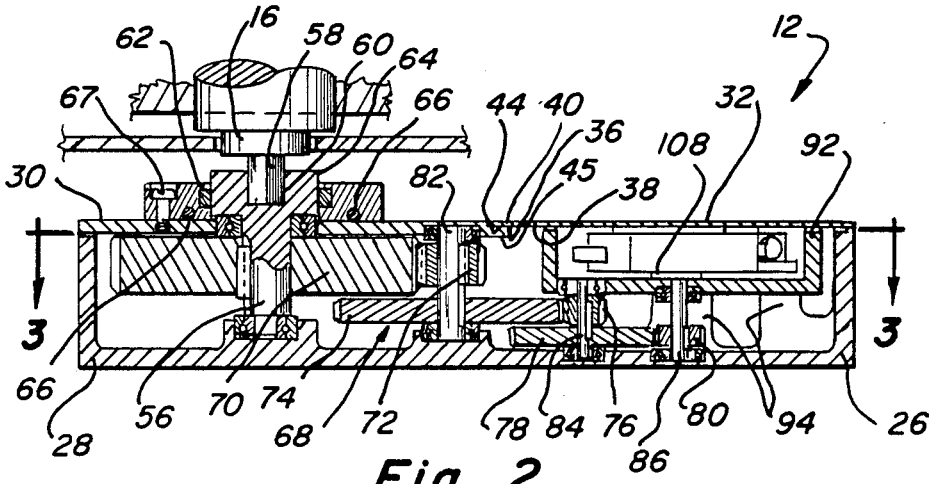
FIG. 2 is a sectional view of the apparatus of this invention taken through section lines 2—2 of FIG. 1.
Figure 3:
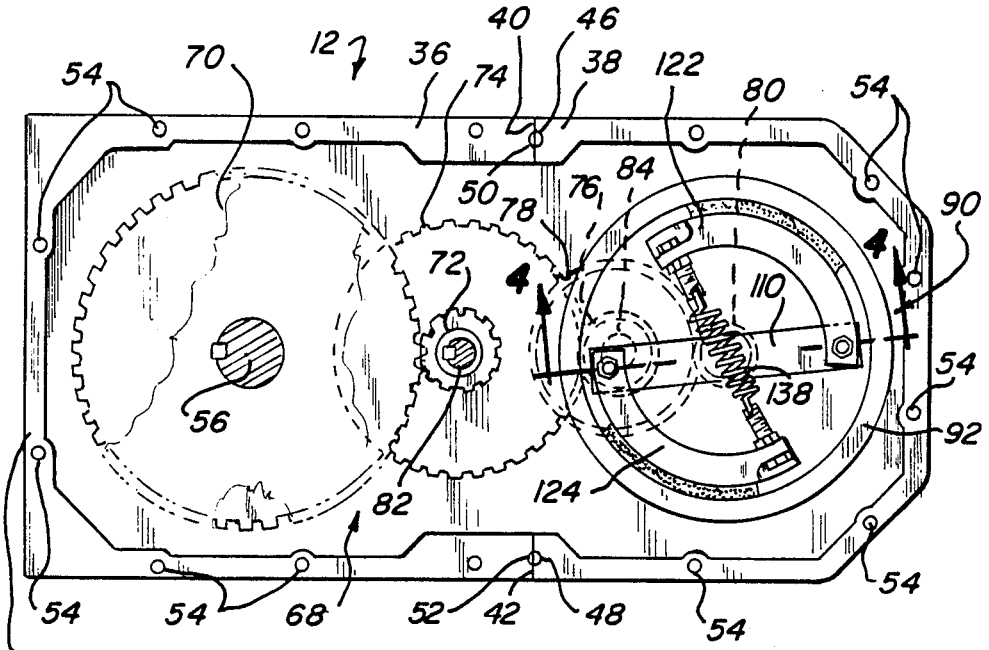
FIG. 3 is a sectional view taken through section lines 3—3 of FIG. 2.

As illustrated in FIGS. 2 and 3, wherein apparatus 12 is illustrated, the apparatus of this invention includes housing 26 having a main body section 28, first cover portion 30 and second cover portion 32. Main housing section 26 has, for example, overall dimensions of approximately 7.75 inches wide, 15.5 inches long and 2.5 inches high. While not particularly necessary for top mount unit 10, bottom mount unit 12 is designed for sealing the unit against invasion thereinto of moisture at the floor and/or escape therefrom of lubricants from the housing. In particular, main body 28 includes horizontal sealing surfaces 36 and 38 separated by vertical sealing surfaces 40 and 42 therebetween. The different horizontal surface levels and the seal between cover portions as hereinafter described are provided for facilitating improved sealing of the bottom unit by limiting the vertical seal area required between covers 30 and 32 along their interface.

Cover 30 is sealed, for example utilizing a gasket compound such as Permatex or silicone, against horizontal surface 36 and vertical surface 40, and cover portion 32 is similarly sealed at horizontal surface 38 of the main body and, at its forward edge, at horizontal surface 44 of cover portion 30 (the step at forward edge 45 of cover portion 30 adjacent surface 44 extending the entire length of edge 45 between the sidewalls of main body section 28).

In order to seal the interface between forward edge 45 of cover portion 30 and vertical surfaces 40 and 42, vertical apertures 46 and 48 are provided in the opposite side walls of main body 28 centered over vertical surfaces 40 and 42. O-ring material 50 and 52, having a diameter somewhat greater than apertures 46 and 48, is placed in the apertures extending up to the level of horizontal surface 38 of main body 28. When first cover section 30 is positioned on surface 36 the o-ring material is squeezed between the main body and the first cover section at surfaces 40 and 42 thus creating a reliable and inexpensive seal at the vertical surfaces.

The cover sections are maintained on the main body utilizing conventional screws or bolts through holes in the cover sections matable with corresponding threaded apertures 54 at surfaces 36 and 38 of main body 28.

Output shaft 56 is provided through cover section 30 for engaging rotatable rod 16 of door 14, for example by having rectangular post 58 of rod 16 insertable into rectangular hole 60 in the enlarged head of output shaft 56. In bottom unit 12 the output shaft must also be sealed to prevent leakage adjacent thereto This is accomplished by utilization of a conventional shaft seal 62 positioned at the interior of collar 64 and further providing o-ring seal 66 at the bottom of the collar adjacent to cover portion 30. O-ring seal 66 is positioned around shaft 56 in collar 64 inwardly from collar mounting screws 67. In this manner, water which may be present at the floor level is prevented from leaking into, and lubricants are sealed within, the housing adjacent to the output shaft.

In order for the braking assembly of this invention to be effectively utilized (as hereinafter set forth) it is necessary to provide a rate of rotation at the shaft associated with the braking structure which is related to, but much greater than, the rate of rotation of output shaft 56. For purposes of thus developing the desired rate of rotation, a standard gear train 68 is provided (it being realized that a variety of other known mechanisms and methods of relating the rotation of two shafts at a selected ratio could be utilized). Gears 70, 72, 74, 76, 78 and 80 are provided in the gear train mounted, variously, on shafts 56, 82, 84 and, with respect to gear 80, shaft 86 associated with the braking assembly hereinafter described. The shafts are conventionally mounted in bearings as shown in FIG. 2. The overall gear ratio of gear train 68 provides a relationship between the rates of rotation of shaft 56 and shaft 86 of, for example, about 1 revolution to 100 revolutions, respectively.

Figure 4:
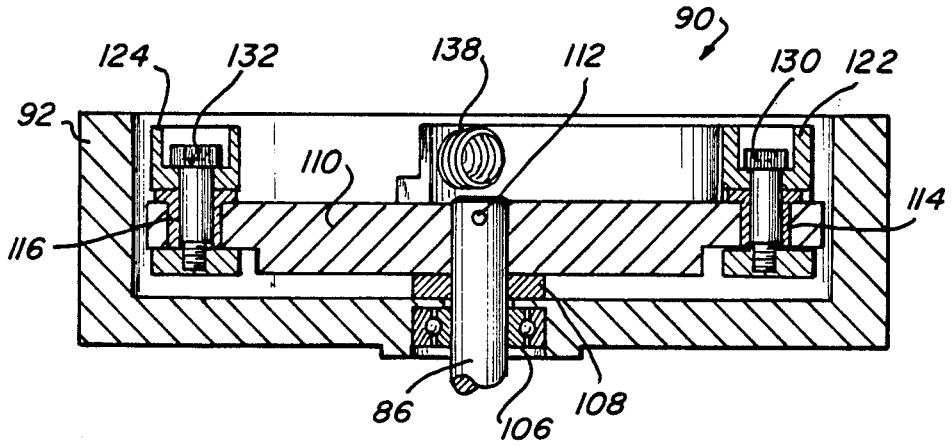
FIG. 4 is a sectional view taken through section lines 4—4 of FIG. 3.
Figure 5:
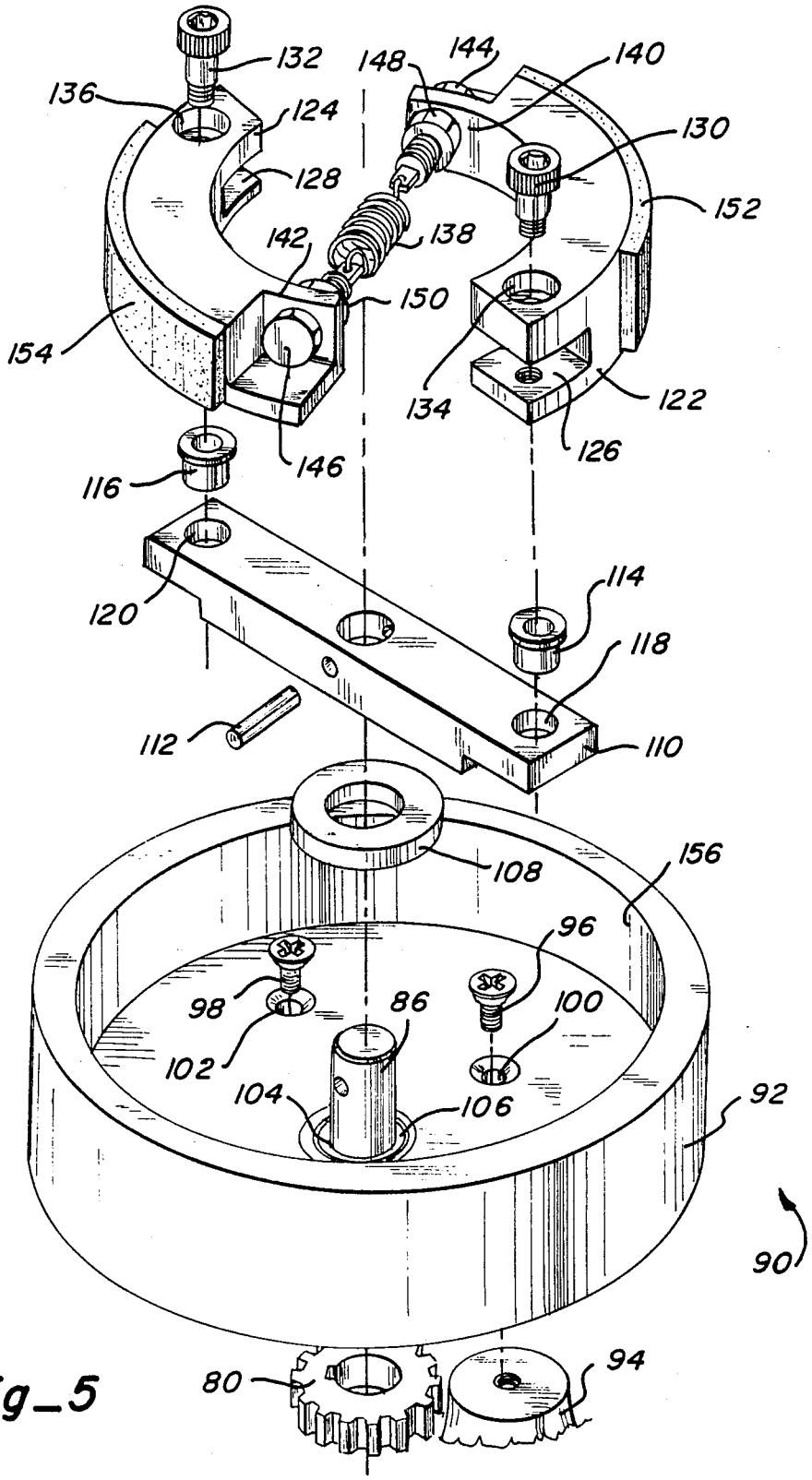
FIG. 5 is an exploded view of the braking assembly of the apparatus of this invention.

As illustrated in FIGS. 3 through 5, braking assembly 90 is maintained adjacent to shaft 86. Restraining member 92, a brake drum, is attached to main body 28 of housing 26 at projections 94 of housing 26 (only one of which is shown in FIG. 5) utilizing screws 96 and 98 through apertures 100 and 102 (a third screw and aperture are provided but are not shown in FIG. 5). The dimensions of drum 92 are, for example, approximately 4.790 inches inside diameter (at the braking surface), 5.490 inches outside diameter, by 1.464 inches high. Shaft 86 extends through aperture 104 in brake drum 92 through bearing 106. Washer 108 is positioned over shaft 86 and carrying member 110 (having an overall length of about 4.5 inches) is attached to shaft 86 utilizing pin 112 for common rotation with the shaft. Bearings 114 and 116 are provided in apertures 118 and 120 at the ends of the carrying member for mounting of pivotable rotation limiting structures, or brake shoes, 122 and 124 at forked ends 126 and 128 utilizing screws 130 and 132 through apertures 134 and 136.

Biasing spring 138 (for example between a 0.055 to 0.065 inch diameter spring steel, stainless steel, or music wire spring) is connected between ends 140 and 142 of the brake shoes at apertures in the ends of adjusting screws 144 and 146 having nuts 148 and 150 associated therewith. Contact surfaces 152 and 154 are provided for contact with the cylindrical wall 156 of drum 92, and are preferably made from a non-asbestos friction material exhibiting substantially the same coefficient of friction when lubricated as when dry (for example utilizing Raybestos brand brake lining material No. M9098-1). This is important since the brake assembly is located within the same housing as the gear train and will, over the life of the unit, undoubtedly receive a variable amount of lubrication. In addition, the contact surfaces have an increased braking surface area (for example approximately 3.45 square inches each) over previously known designs thus giving a longer life to the friction material When shaft 86 exceeds a pre-established rate of rotation, brake shoes 122 and 124 pivot outward bringing contact surfaces 152 and 154 into contact with the cylindrical wall 156 of the brake drum. Once engaged, a specific drag torque is provided which increases in proportion to the square of the angular rotation speed of brake shoes 122 and 124 (for example preferably providing a drag torque of between 1 and 5.5 inch pounds at the brake shoe surface for an angular rotation speed of between 1,000 and 1,500 rpm, thus providing 100 to 550 inch pounds of braking torque at the door rod). By changing the preload force on biasing spring 138 and/or the material used to construct brake shoes 122 and 124 the speed at which such engagement occurs can be adjusted in a range of about 200 to 1,000 revolutions per minute of shaft 86 (corresponding, for example, to about 2 to 10 revolutions per minute of rod 16 and thus door 14).

For example, by adjusting adjusting screws 144 and/or 146 to provide a spring preload force of 10 pounds of force and constructing the brake shoes of aluminum thereby providing a mass of 0.25 pounds for each shoe, the speed of engagement is approximately 200 revolutions per minute. By adjusting the spring load force in such case to a load of 250 pounds the speed of engagement is approximately 1,000 revolutions per minute. On the other hand, when utilizing steel material for shoes 122 and 124 thus providing a mass of 0.75 pounds for each shoe, a spring preload force of between 30 pounds and 750 pounds will produce engagement at between 200 and 1,000 revolutions per minute.

As may be appreciated from the foregoing, a speed control apparatus for controlling the rate of rotation of a shaft connected with a door to thus control the rate of motion of the door is provided which includes improved sealing of the housing containing the speed control apparatus, an improved braking assembly including improved friction materials equally suitable to both lubricated and dry environments, and with the braking assembly being more easily adjustable and maintainable to provide proper braking torque.

What is claimed is:

1. A control apparatus for controlling rate of rotation of a shaft connected with a door to thus control rate of motion of the door, the shaft having an end through which its axis of rotation is defined, said apparatus comprising:

a restraining member positioned around and spaced from the shaft;

first and second rotation limiting means each having a first end portion pivotably connected with the shaft and a second end portion so that when the shaft rotates said rotation limiting means revolve around the shaft adjacent to said restraining member, said rotation limiting means each having a contact surface for contacting said restraining member when a selected rate of rotation of the shaft is exceeded to thus encumber free rotation of the shaft;

a single biasing means connected between said second end portions of said first and second rotation limiting means and having a portion extending adjacent to the end of the shaft through the defined axis of rotation, said biasing means for biasing said contact surfaces away from said restraining member; and converting means connected between the shaft and the door for causing rotation of the shaft at a preselected relative rate of rotation, said relative rate of rotation being related to the rate of motion imparted to the door under the control of a user of the door by a selected ratio, and for responding to encumbrance of the rate of rotation of the shaft cause by contact between said contact surface of said rotation limiting means and said restraining member to control the rate of motion of the door and thus inhibit motion thereof in excess of a selected desirable rate.

2. The apparatus of claim 1 wherein said apparatus further comprises housing means for housing the shaft, said restraining member, said rotation limiting means, said biasing means and said converting means therein.

3. The apparatus of claim 1 wherein said contact surface of said rotation limiting means is a non-asbestos friction material exhibiting substantially the same coefficient of friction in contact with said restraining member when lubricated as when dry.

4. The apparatus of claim 1 further comprising a carrying member connected with the end of the shaft, and wherein said first and second rotation limiting means are first and second brake shoes each pivotably connected with said carrying member.

5. The apparatus of claim 1 wherein said biasing means is a biasing spring having a selected preload force connected at opposite end portions thereof between said second end portions of said first and second rotation limiting means.

6. The apparatus of claim 5 wherein at least one of said first and second rotation limiting means includes adjusting means for adjusting said preload force of said biasing spring.

7. The apparatus of claim 1 wherein said converting means is a gear train connected between the door and the shaft.

8. For use with a door assembly, a control apparatus for controlling rate of rotation of a shaft connected with a door to thus control rate of motion of the door, the shaft having an end, said apparatus comprising:

a cylindrical wall positioned around and spaced from the shaft;

a carrying member connected with the end of the shaft at a central part of said carrying member so that the shaft substantially terminates at said carrying member, rotation of the shaft inducing rotation of said carrying member;

first and second rotation limiting means operatively associated with said carrying member and having a contact surface at one part thereof for contacting said cylindrical wall when a selected rate of rotation of the shaft is exceeded to thus encumber free rotation of the shaft;

a single biasing member connected between said first and second rotation limiting means across said carrying member and adjacent to the end of the shaft for, without need for any additional biasing means, biasing said rotation limiting means away from said cylindrical wall; and converting means connected between the shaft and the door for causing rotation of the shaft at a preselected relative rate of rotation, said relative rate of rotation being related to the rate of motion imparted to the door under the control of a user of the door by a selected ratio, and for responding to encumbrance of the rate of rotation of the shaft caused by said rotation limiting means to control the rate of motion of the door and thus inhibit motion thereof in excess of a selected desirable rate.

9. The control apparatus of claim 8 wherein said first and second rotation limiting means are first and second braking members pivotably connected with said carrying member and each having a contact surface at one part thereof, said first and second braking members pivoting outwardly from said carrying member when a selected rate of rotation of the shaft is exceeded to thus cause contact between said cylindrical wall and said contact surfaces.

10. The apparatus of claim 9 wherein each of said braking members has first and second end parts, said first end parts being pivotably connected with said carrying member and said second end parts each being connected with said biasing member.

11. The apparatus of claim 8 wherein said contact surface of said rotation limiting means is a non-asbestos friction material exhibiting substantially the same coefficient of friction in contact with said cylindrical wall when lubricated as when dry.

12. The apparatus of claim 8 wherein said apparatus includes housing means for housing the shaft, said cylindrical wall, said carrying member, said rotation limiting means, said biasing member, and said converting means, said housing means including a main body and first and second cover sections, a part of said first cover section being sealably positionable against both a horizontal and a vertical surface of said main body, and a part of said second cover section being sealably positionable against a horizontal surface of said first cover section.

13. The apparatus of claim 8 wherein each of said first and second rotation limiting means includes adjusting means for adjusting the preload force exerted thereon by said single biasing member.

14. For use with a revolving door assembly, a speed control apparatus for controlling the rate of rotation of a revolving door, the revolving door assembly including a rotatable rod, said apparatus comprising:

a braking assembly including a shaft, a brake drum positioned around and spaced from said shaft, rotation limiting means having a first end part connected with said shaft and a second end part, and single biasing means connected with said rotation limiting means for biasing said rotation limiting means away from said brake drum;

converting means connected between said shaft and the rotatable rod of the revolving door for causing rotation of said shaft at a preselected relative rate of rotation, said relative rate of rotation being related to the rate of rotation imparted to the rod during use of the revolving door by a selected ratio, and for responding to encumbrance of the rate of rotation of said shaft caused by contact between said rotation limiting means and said brake drum when a selected rate of rotation of said shaft is exceeded to thereby control the rate of rotation of the rod and thus inhibit rotation of the revolving door in excess of a selected desirable rate of rotation; and housing means for housing said braking assembly and said converting means therein and including a main body and first and second cover sections, said main body having said braking assembly located in one portion thereof, a part of said first cover section being sealably positionable against both a horizontal and a vertical surface of said main body, and a part of said second cover section being sealably positionable against horizontal surfaces of said first cover section and said portion of said main body.

15. The speed control apparatus of claim 14 wherein said converting means includes an output shaft extendable through said housing means at one part thereof and having the rotatable rod of the revolving door assembly receivable thereat, and wherein said housing means includes an output shaft sealing collar including a first seal between said collar and said output shaft and a second seal between said collar and said first cover section of said housing means.

16. The apparatus of claim 14 wherein said housing means includes first and second vertical apertures in said main body section centered at an interface between said horizontal and said vertical surfaces thereof and first and second sealing members positionable in different ones of said apertures for sealing said housing means between said first cover section and said vertical surface of said main body thereat.

17. The apparatus of claim 14 wherein said rotation limiting means includes first and second brake shoes each having a first end part pivotably connected with said shaft and each having a second end part having said biasing means connected therewith.

18. The apparatus of claim 17 wherein said biasing means is a biasing spring having a selected preload force connected at opposite ends thereof between said second end parts of said first and second brake shoes.

19. The apparatus of claim 18 wherein said first and second brake shoes include adjusting means for adjusting said preload force exerted by said biasing spring.

20. The apparatus of claim 14 wherein said rotation limiting means includes a contact surface at one part thereof for contacting said brake drum when a selected rate of rotation of said shaft is exceeded to thus encumber free rotation of the shaft, said contact surface being a non-asbestos friction material exhibiting substantially the same coefficient of friction in contact with said brake drum when lubricated as when dry.

* * * * *